US008627562B2

(12) United States Patent
Sutter et al.

(10) Patent No.: US 8,627,562 B2
(45) Date of Patent: Jan. 14, 2014

(54) APPLICATION TOOL FOR COAXIAL CABLE COMPRESSION CONNECTORS

(75) Inventors: Robert W. Sutter, Dekalb, IL (US); Stephen J. Skeels, Manlius, NY (US)

(73) Assignee: IDEAL Industries, Inc., Sycamore, IL (US)

( * ) Notice: Subject to any disclaimer, the term of this patent is extended or adjusted under 35 U.S.C. 154(b) by 352 days.

(21) Appl. No.: 13/194,085

(22) Filed: Jul. 29, 2011

(65) Prior Publication Data

US 2012/0017432 A1 Jan. 26, 2012

Related U.S. Application Data

(62) Division of application No. 12/548,695, filed on Aug. 27, 2009, now Pat. No. 8,015,698, which is a division of application No. 11/673,335, filed on Feb. 9, 2007, now Pat. No. 7,596,860.

(51) Int. Cl.
*H01R 43/02* (2006.01)

(52) U.S. Cl.
USPC ..... 29/751; 29/753; 29/758; 29/760; 29/863

(58) Field of Classification Search
USPC ..... 29/748–751, 753–758, 828, 283; 72/409.19; 7/107, 158
See application file for complete search history.

(56) References Cited

U.S. PATENT DOCUMENTS

| | | | | |
|---|---|---|---|---|
| 4,534,107 | A * | 8/1985 | Maack | 29/751 |
| 5,647,119 | A | 7/1997 | Bourbeau et al. | |
| 5,934,137 | A | 8/1999 | Tarpill | |
| 6,293,004 | B1 | 9/2001 | Holliday | |
| 6,594,888 | B2 | 7/2003 | Chang | |
| 6,708,396 | B2 | 3/2004 | Holliday | |
| 6,820,326 | B1 | 11/2004 | Tarpill et al. | |
| 7,028,393 | B2 | 4/2006 | Wei | |
| 7,120,997 | B2 | 10/2006 | Islam et al. | |
| 7,299,542 | B2 | 11/2007 | Montena | |
| 7,797,827 | B2 * | 9/2010 | Sutter | 29/861 |
| 8,256,102 | B2 * | 9/2012 | Sutter et al. | 29/751 |
| 2009/0004914 | A1 | 1/2009 | Sutter | |

* cited by examiner

*Primary Examiner* — Minh Trinh
(74) *Attorney, Agent, or Firm* — Cook ALex Ltd.

(57) ABSTRACT

A tool for installing compression connectors of various sizes and types on the end of a coaxial cable has a base mounting a pair of movable anvils for engaging two different lengths of connectors. The base further incorporates a fixed anvil for engaging a third length of connector. The movable anvils define an aperture which is shaped to permit easy entry and exit of a cable while still applying a suitable retention force to an inserted cable. A connector seating holder is formed in the front of the tool. A slidably mounted plunger cooperates with the anvils to compress a connector. The plunger has a push head and a slide rod. A lock nut is threaded on the push head and is engageable with the slide rod to prevent rotation of the push head.

4 Claims, 8 Drawing Sheets

10
12
14
16
18
20
22
24
26
28
30
34
36
38
40
44
46
48
52
54
56
60A
60B
60C
62A
62B
62C
64
84
86
88
90
92
94
96
98
99
100
102
104
106
107
108
110
112

APPLICATION TOOL FOR COAXIAL CABLE COMPRESSION CONNECTORS

CROSS-REFERENCE TO RELATED APPLICATIONS

This application is a divisional application of application Ser. No. 12/548,695, filed Aug. 27, 2009 now U.S. Pat. No. 8,015,698, which is a divisional of application Ser. No. 11/673,335 filed Feb. 9, 2007, now U.S. Pat. No. 7,596,860, the disclosures of which are hereby incorporated herein by reference in their entirety.

BACKGROUND OF THE INVENTION

This invention relates to a tool for installing compression connectors on the end of coaxial cable. Such connectors come in a variety of styles and sizes. Among the styles are F-type, BNC and RCA connectors. Among the sizes are RG-6, RG-11 and RG-59. Details of the three connector styles are shown in U.S. Pat. No. 7,153,159. Installation of each style of compression connector entails inserting the prepared end of a coaxial cable a predetermined distance into the connector and then compressing the connector to deform a portion of it and lock it onto the cable. Compression tools for performing this function are known. Such tools have a zone which receives a connector pressed onto the end of a coaxial cable. A compressive force then is applied to the ends of the connector to deform the connector and complete the installation.

One disadvantage of early compression tools is the compression chamber is sized to accept only a single size or type of connector. Several such tools were required in a technician's toolbox to accommodate all the sizes that might be needed. Some prior art tools addressed this problem by providing multiple, separate inserts or plungers to accommodate different connector sizes. However, this requires the technician to change out the tool parts every time a different size connector is encountered. Time is lost performing the change. Furthermore, this type of multiple component tool still does not remove the need to have separate tools or components for separate sizes of connectors.

A prior art tool that does accommodate two different connector sizes in a single tool with no removable parts is shown in U.S. Pat. No. 6,820,326. This tool has two pairs of split bases at separate longitudinal locations in the compression chamber. While this allows the tool to be used on two different connector sizes, it introduces problems of its own. Chief among these is the inability to release a finished cable/connector combination without separate manipulation of the split bases. A user typically holds the compression tool in the palm of one hand and the cable/connector in the other hand. The cable/connector is inserted into the compression chamber where the split bases engage the cable and provide the abutment for the back end of the connector. Then the tool handle is squeezed to perform the compression. Now the finished cable is ready for release from the tool but the split bases will not readily release it. Instead the user has to perform an awkward maneuver in which he or she balances the tool in the palm and outer fingers so the thumb and forefinger are available to actuate the split bases to the open position. Alternately, the user might try a similar maneuver with the opposite hand, that is, grasping the cable with a couple fingers while opening the split bases with two other fingers and then pulling one hand away to remove the cable from the tool. Neither of these methods of releasing a finished cable from the tool is convenient. It has also been found that this tool does not work well with RG-11 F-type compression connector.

SUMMARY OF THE INVENTION

The present invention provides a tool for installing compression connectors of various sizes and types on the end of a coaxial cable without the need for multiple tools or components. The tool of the present invention has a pair of movable anvils for engaging two different lengths of connectors and a fixed anvil for engaging a third length of connector. The movable anvils have an aperture which defines a throat that is large enough to permit easy entry and exit of a cable and small enough to apply a suitable retention force so that a cable will not inadvertently come out of or move around in the aperture prior to compression. The anvils each have a pair of movable spring clips with a depression or cutout in an edge thereof such that opposed spring clips define the cable-receiving receptacle. A connector seated at the proper location on the end of the cable is placed between the plunger and face of the anvil with the cable extending through the aperture in the anvil. Then the plunger is actuated to compress the connector and fix it in place on the cable. After retraction of the plunger a radial movement of the finished cable/connector combination is all that is needed to remove the finished cable from the compression zone. The arrangement of the anvil apertures is such that separate releasing activation of the spring clips is not necessary. In an alternate embodiment, the anvil may have a tear-drop shaped aperture, either with or without a throat.

DETAILED DESCRIPTION OF THE INVENTION

Figures 1, 2:
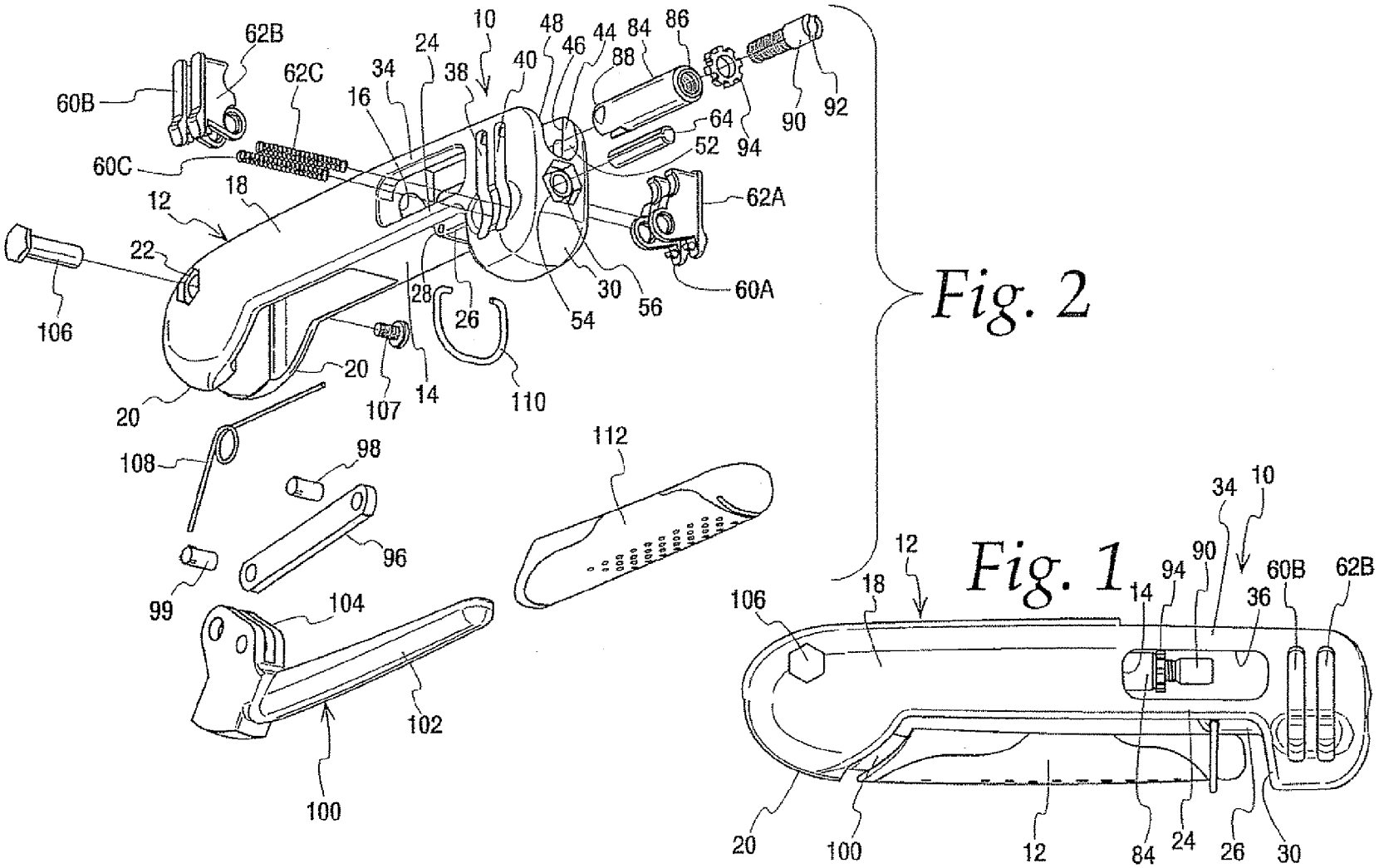
FIG. 1 is a side elevation view of the application tool of the present invention with the handle shown in an actuated position.
FIG. 2 is an exploded perspective view of the application tool.
Figure 3:
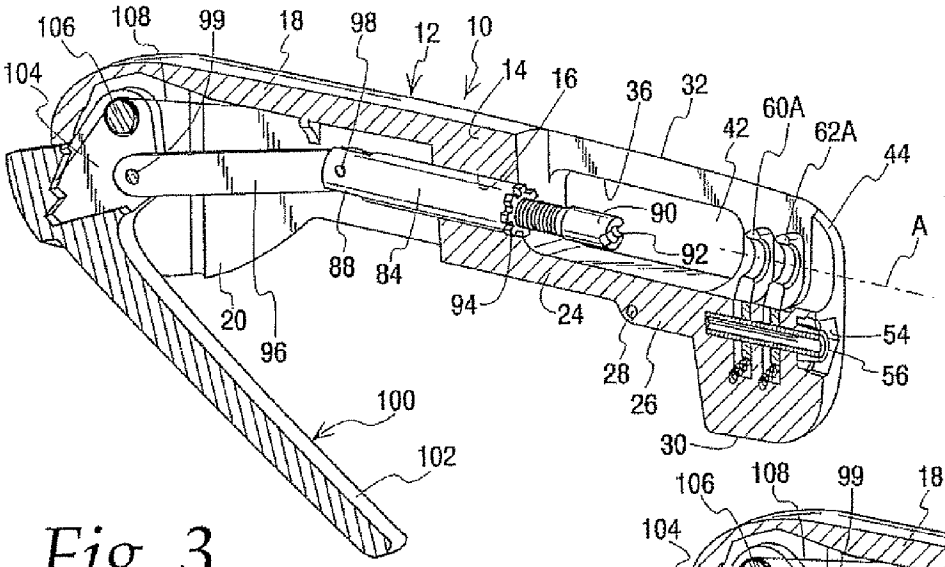
FIG. 3 is a perspective view of a longitudinal section through the tool, with the plunger shown in a retracted position.
Figure 17:
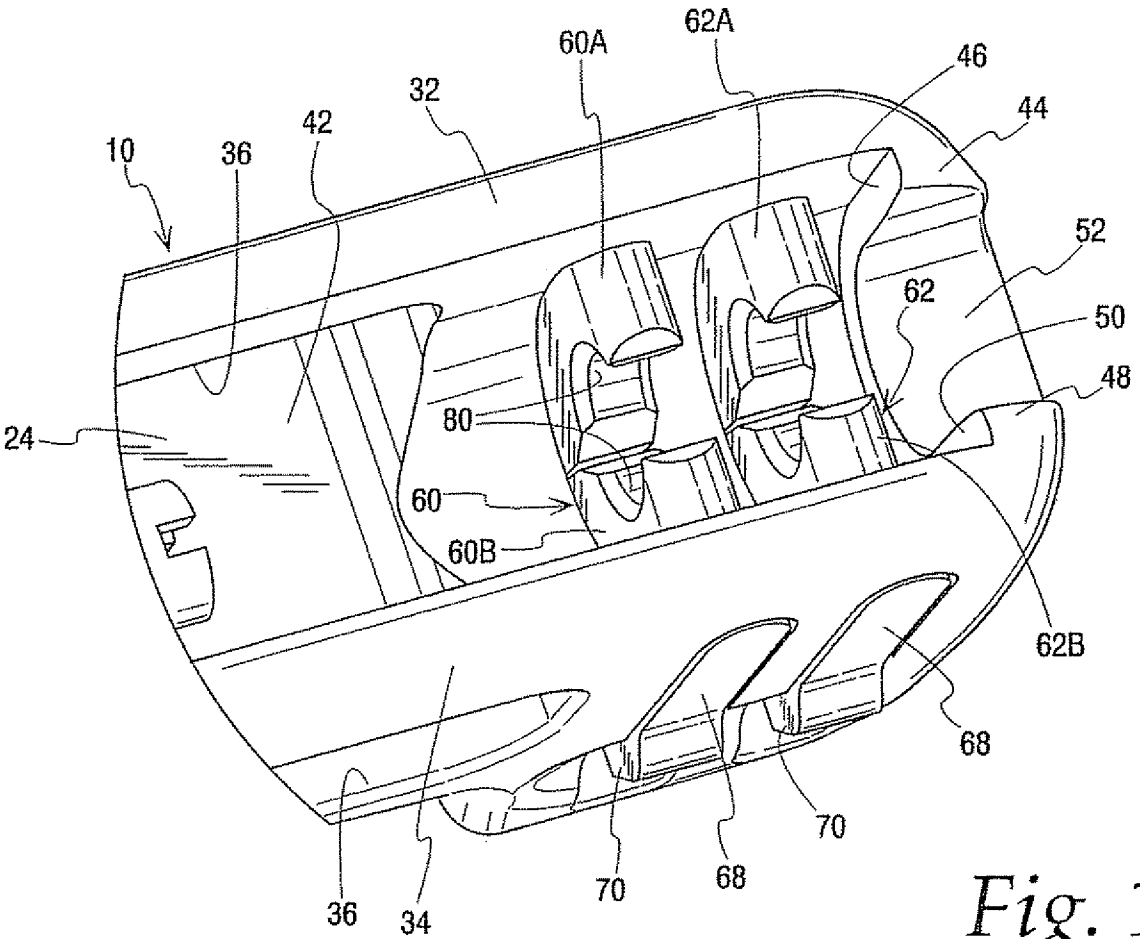
FIG. 17 is a perspective view of the application tool looking toward the forward end of the compression zone.

FIG. 1 illustrates the application tool of the present invention generally at 10. The tool includes a base 12. The details of the base are best seen in FIGS. 2 and 3. The base includes a central block member 14 having a bore 16 formed therein. A generally three-sided heel section 18 extends rearwardly from the block member. The heel section is hollow and open at its lower side. Rounded ears 20 are formed at the rear of the heel 18. There are transverse, aligned holes 22 in the heel above the ears 20. Extending forwardly of the block member 14 is a beam 24. About midway along the beam there is an enlargement 26 which includes a transverse hole 28. Forwardly of the enlargement 26 the front portion of the beam 24 carries a depending anvil mount 30. Above the anvil mount there are two side walls 32, 34 joined to the beam 24. The side walls extend back to the block member 14. There are windows 36 in the side walls. Two transverse slots 38, 40 are formed in the anvil mount 30. These slots extend up into the side walls 32, 34 as best seen in FIG. 2. Together the front surface of the block member 14, the top surface of the beam 24 and the inside surfaces of the side walls 32, 34 define a compression zone 42 having a longitudinal axis A. At its forward end the side wall 32 joins an abutment 44 which has a rearwardly-facing, fixed bearing surface 46. Fixed bearing surface 46 extends transversely of the axis A. Similarly, side wall 34 terminates at an abutment 48 which includes a fixed bearing surface 50. See FIGS. 15 and 17 also. The bearing surfaces 46, 50 are coplanar. It will be noted that the forward ends of the abutments 44, 48 have a curved lower portion which, taken together, define U-shaped opening 52 into the compression zone.

The front or nose of the anvil mount 30 has a connector seating holder 54. In this embodiment the holder 54 is a hexagonal depression in the anvil mount with a central post 56 disposed in the depression. The post 56 surrounds a bore 58 (FIG. 4) that extends longitudinally into the anvil mount 30. The depression is sized to receive the front end of a compression connector therein. The holder 54 retains the connector while a prepared cable is seated on the back end of the connector prior to compression. Further details of this process will be described below.

Figure 4:
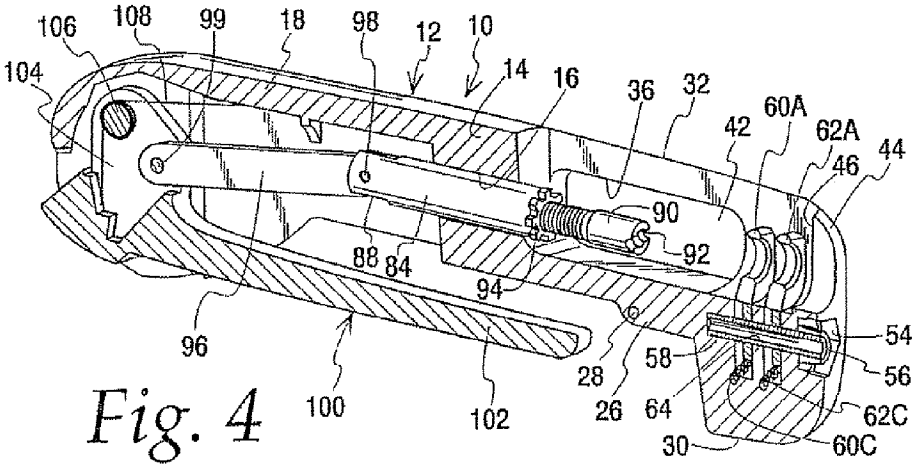
FIG. 4 is a perspective view of a longitudinal section through the tool, with the plunger shown in an actuated position.

Attention will now be turned to the components attached to the base 12. First and second anvils 60 and 62 are retractably insertable into the compression zone 42 between open and closed positions. A complete anvil comprises two spring clips and a clip spring. Thus, first anvil 60 has a left spring clip 60A, a right spring clip 60B and a clip spring 60C. Similarly, anvil 62 has a left spring clip 62A, a right spring clip 62B and a clip spring 62C. The spring clips of the first anvil 60 are mounted in the transverse slot 38 of the anvil mount 30, as seen in FIGS. 3 and 4. The spring clips of the second anvil 62 are similarly mounted in the transverse slot 40. All of the spring clips are pivotally mounted on a spring pin 64 which is set in the bore 58 of the anvil mount 30.

Figure 7:
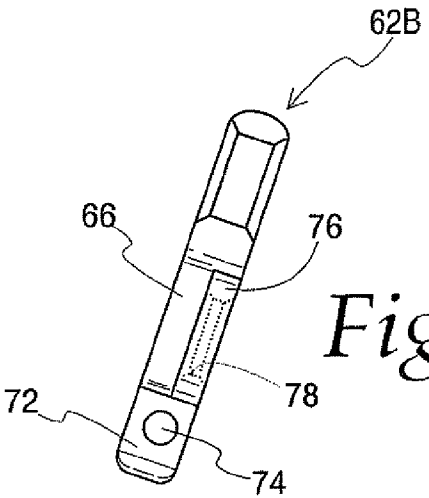
FIG. 7 is a side elevation view of the spring clip, looking in the direction of line 7-7 of FIG. 6.
Figure 5:
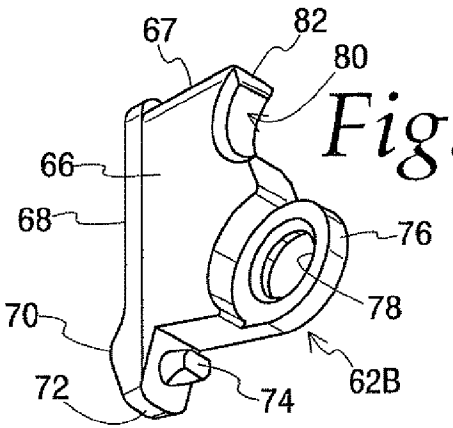
FIG. 5 is a perspective view of a spring clip.
Figure 6:
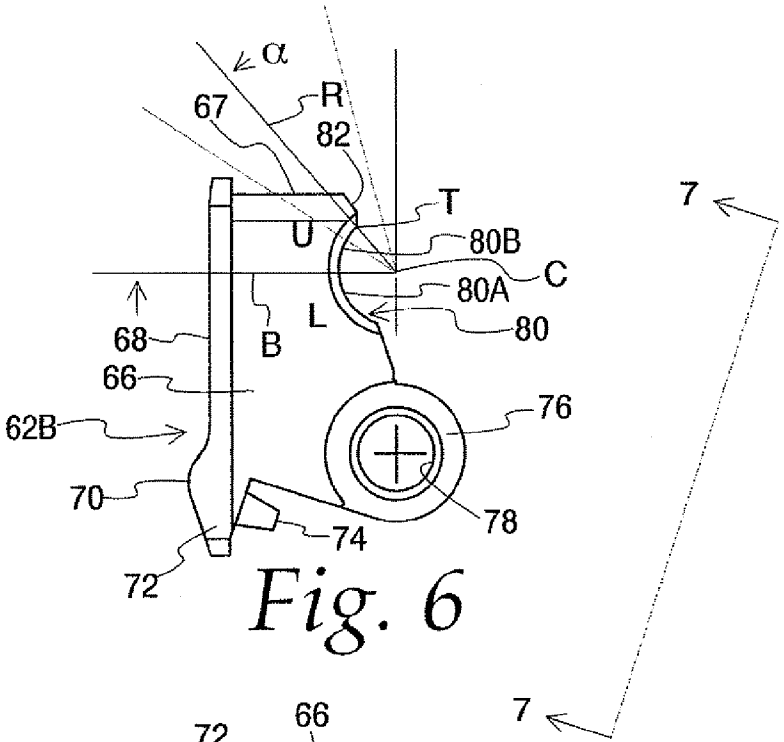
FIG. 6 is a front elevation view of the spring clip of FIG. 5.
Figure 8:
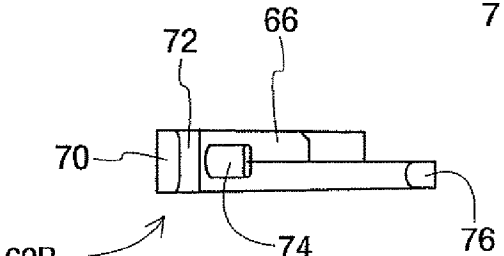
FIG. 8 is a bottom plan view of the spring clip.

Details of a spring clip 62B are shown in FIGS. 5-8. In this embodiment all of the four spring clips used in the two anvils are identical so all the others would look the same as 62B shown, except the installed left spring clips would be flipped around from the orientation shown in FIG. 5. The spring clip has a plate 66. The rear surface of the plate defines a bearing surface. The plate is bounded on top by a head 67 and on one side by a generally vertical edge 68. Near the bottom of the vertical edge is a knuckle 70 extending therefrom. At the lower portion of the plate a foot 72 carries a peg 74. On the side edge of the plate opposite the knuckle 70 there is a circular ring 76. An opening 78 extends through the ring. The opening receives the spring pin 64 when the clips are mounted in the anvil mount 30 so the clips are reciprocally movable into and out of the compression zone 42. The ends of the clip springs 60C or 62C seat on the pegs 74 and normally bias the upper portions of the spring clip toward one another, i.e., into the compression zone 42. It will be noted that the ring has half the thickness of the remainder of the plate, as seen in FIGS. 5, 7 and 8. Thus when two spring clips are placed with their rings adjacent one another and the axes of the openings 78 aligned, the faces of the spring clips will be coplanar. This allows the spring clips to fit fairly snugly in the transverse slots, with sufficient clearance for easy movement but without allowing the spring clips to cant in their slots.

Above the ring 76 the edge of the plate has an aperture 80. The aperture is beveled at the front and rear faces of the plate. In this case the aperture is circular, although its shape could be other than a circle. The center of the aperture circle is at C. The horizontal centerline of the aperture is shown at B. It defines upper and lower quadrants U and L of the aperture 80. The portion of the plate edge that defines the aperture in the lower quadrant L, i.e., the edge portion below the centerline B can be considered a support surface 80A. The portion of the plate edge that defines the aperture in the upper quadrant U, i.e., the edge portion above the centerline B defines a retention surface 80B. The retention surface in this embodiment defines a circular arc. The retention surface terminates in the upper quadrant at terminus T. An angle between the horizontal centerline and a radius R through the terminus T defines what will be referred to herein as a closure angle $\alpha$. By way of example, and not by limitation, the closure angle in the illustrated embodiment is about 50°. The terminus is joined to the head 67 by an entry surface 82 which is angled from the vertical to assist in guiding a cable into the aperture.

Figure 9:
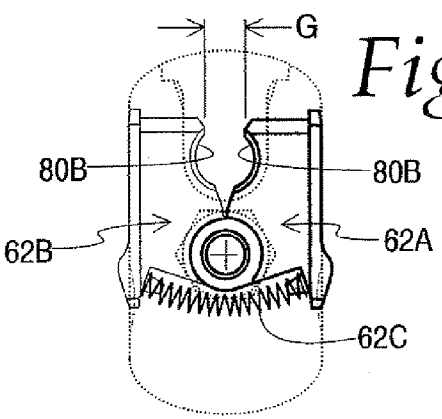
FIG. 9 is a front elevation view of an anvil looking along line 9-9 of FIG. 14, with the outline of the tool base shown in phantom.

The closure angle $\alpha$ is important because it determines the ability of the spring clips to capture and release a cable inserted into the tool's compression zone. This will become evident by examination of anvil 62 in FIG. 9. As mentioned above, the complete anvil 62 comprises the left and right spring clips 62A and 62B and clip spring 62C. The apertures 80 of the cooperating spring clips lie side by side to define a cable receiving receptacle. There is a throat or gap G between the terminus points of the two spring clips' apertures. It is important to properly size this throat or gap such that coaxial cables can be readily inserted into and removed from the receptacle but at the same time the clips will impart a retaining force that prevents inadvertent slippage of the cable from the receptacle. In other words, a cable receptacle having a completely open slot at its entry point is undesirable because the cable is then totally free to move out of position for crimping. The spring clips must surround a portion of the upper quadrants of a cable therein to provide a retaining function. But the spring clips can only surround a portion of the cable. If the spring clips fully surround the cable they prevent ready release of the cable when it is finished, which would then require the awkward manipulation of the clips as described above. Thus, the spring clips must provide some, but not too much, restraint on a cable in the cable receiving receptacle. The compromise struck by the present invention between too little and too much restraint can be defined in two ways. One is by describing the closure angle as being at least 33° and not more than 75°. About 50° is preferred. This will extend the clip surface defining the aperture 80 sufficiently into the upper quadrant U to engage enough of an inserted cable to hold it for crimping and release it after crimping. Alternately, since the retention surfaces of the apertures 80 need not be circular, the throat or gap G between the terminus points of the apertures could be about 0.075 inches to about 0.250 inches, with about 0.19 inches being preferred. It has been found that a throat or gap of this amount will provide sufficient holding force on a cable in the receptacle prior to crimping while readily releasing a cable after crimping.

Figure 14:
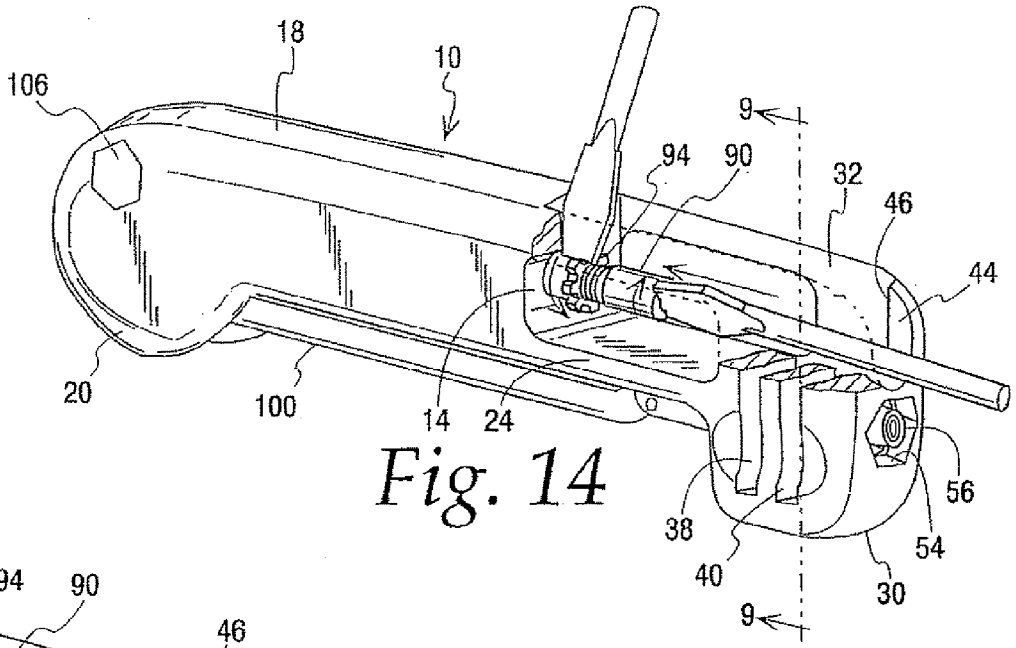
FIGS. 13 and 14 are perspective views of the application tool with portions broken away to illustrate adjustment of the lock nut and plunger.
Figure 13:
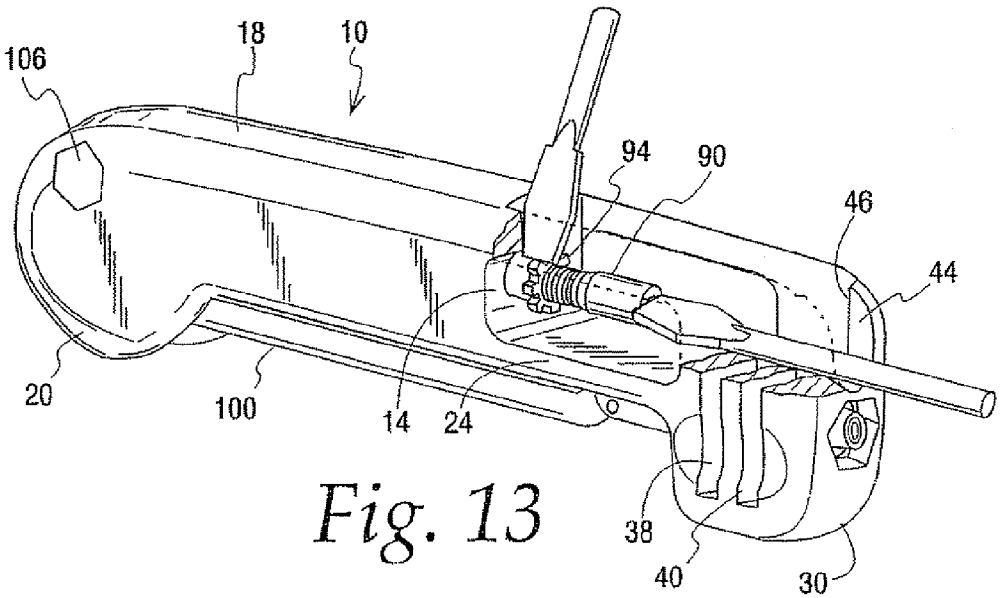

Returning now to FIGS. 1-3, the remaining parts of the application tool will be described. A cylindrical slide rod 84 is mounted for slidable translation in the bore 16 of the block member 14. The rod has a threaded bore 86 at its forward end and a clevis 88 at its rear end. A push head 90 has a slot 92 at its forward end. Much of the body of the push head has external threads which engage the internal threads of the slide rod 84. Together the slide rod 84 and push head 90 form a plunger. A lock nut 94 has internal threads and external teeth. The lock nut is threaded on the push head and is engageable with the leading edge of the slide rod to prevent rotation of the push head. FIGS. 13 and 14 illustrate how the overall length of the plunger is adjustably fixed. To change the length of the plunger, a user inserts a screwdriver blade into the compression zone 42 to engage the teeth of the lock nut and loosen it from the slide rod. This then permits a screwdriver engaged with slot 92 in the push head to rotate the push head as needed to lengthen or shorten the plunger. Once the desired length is obtained by turning the push head, the lock nut 94 is tightened against the end face of the slide rod to prevent further rotation of the push head. Thus, the length of the plunger can be easily adjusted using ordinary tools that are always available.

A push rod 96 connects to the clevis 88 of the slide rod 84 by means of a groove pin 98. The groove pin fits transversely through aligned openings in the clevis and slide rod. A second groove pin 99 joins the other end of the push rod 96 to a handle 100. The handle has an elongated arm 102 connected at one end to a clevis 104. Aligned openings in the clevis 104 receive the groove pin 99. Another set of openings in the clevis receive a handle anchor pin 106. Anchor pin 106 extends through the holes 22 in the ears 20 to mount the handle for rotation about the pin. An anchor pin screw 107 threads into the end of the pin 106 to fix it in position.

The anchor pin 106 also fits through a torsion spring 108. One leg of the spring engages the inside of the heel 18 and the other leg engages the arm 102 to bias the arm away from the heel. A U-shaped wire hasp 110 has free ends which slip into either end of the transverse hole 28 in the beam 24. The hasp pivots between open and closed positions where it either releases the handle or holds it in the closed position of FIG. 1. A handle grip 112 slides over the arm 102 to provide a comfortable surface for a user to grasp. The hasp 110 is large enough to accommodate the grip 112.

Figures 15, 16:
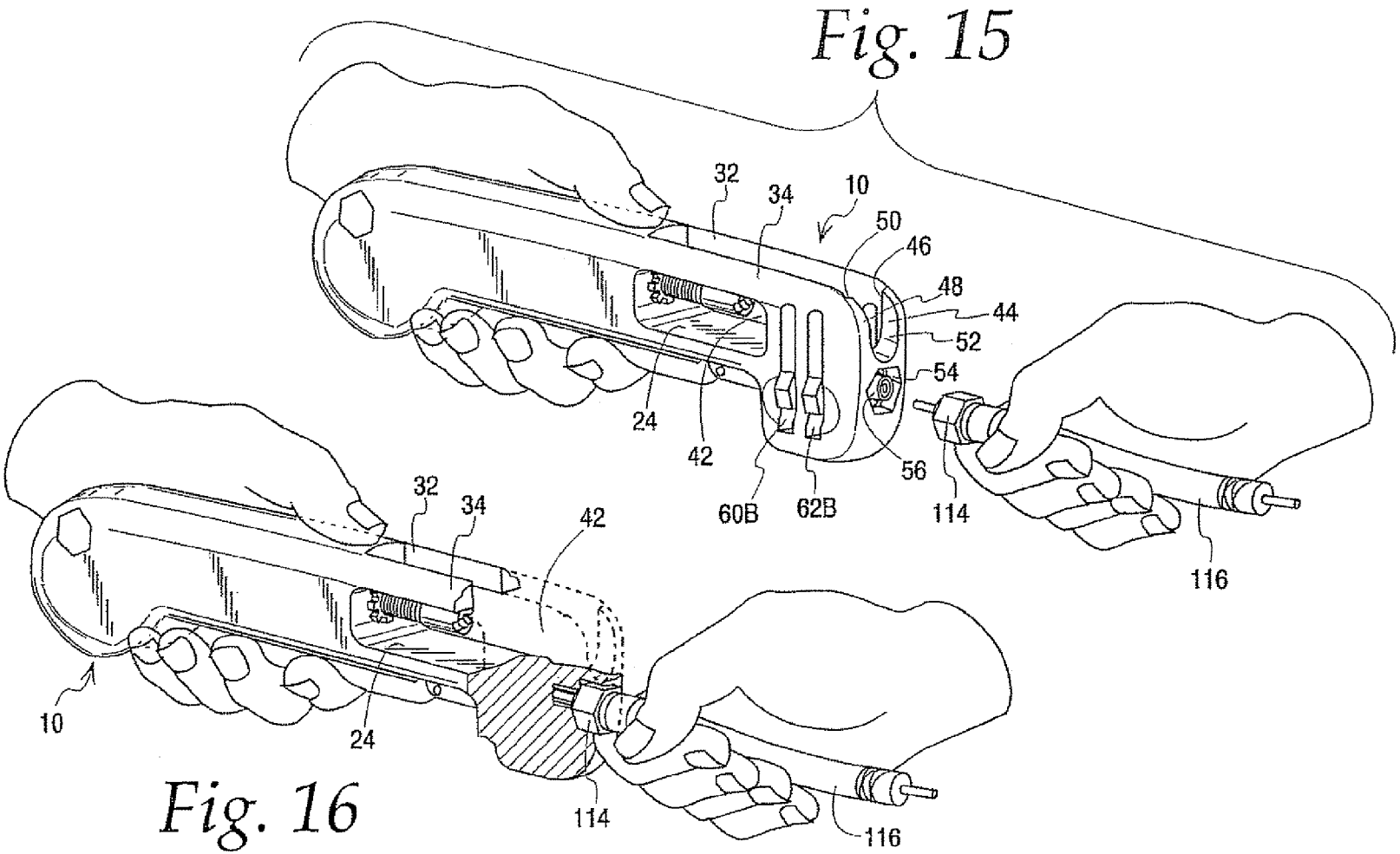
FIGS. 15 and 16 are perspective views of the application tool, with portions broken away in FIG. 16, illustrating the connector seating holder and its use.

The use, operation and function of the application are as follows. The user first sets the plunger to the desired length as described above. The hasp 110 is rotated toward the anvil mount 30 to release the handle 100. The torsion spring biases the handle to an open position as seen in FIG. 3. This rotates the handle clevis 104 away from the block member 14 and causes retraction of the push rod 96 and slide rod 84. The tool is now ready for use. The user prepares a coaxial cable by stripping it appropriately and seating the desired connector type on the stripped cable end. The connector seating holder 54 can be used to assist in inserting the cable the requisite distance into the connector. As seen in FIGS. 15 and 16 a user grasps the tool 10 in one hand and puts a connector 114 loosely on the end of a coaxial cable 116. The free end of the connector is then inserted into the depression of the seating holder 54. The user can then press the tool and cable together to push the connector the required distance onto the cable. As this is done there is no possibility of the user being injured by a sudden thrusting of the central conductor of the cable through the front end of the connector.

Figure 12:
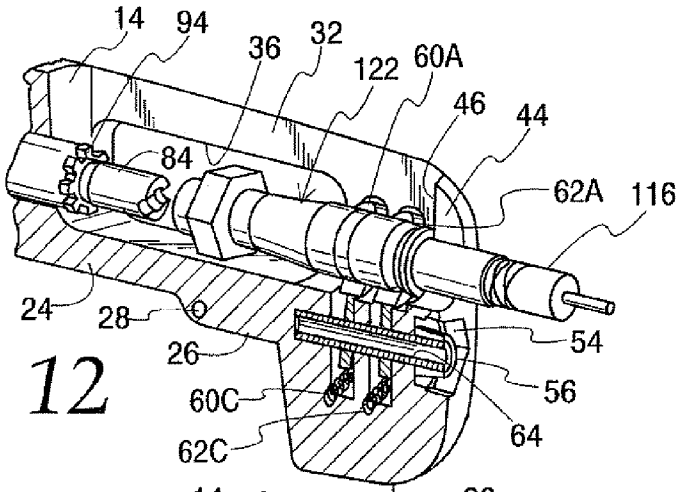
FIG. 12 is a perspective view of a longitudinal section through the compression zone, showing an RG-11 F-connector loaded in engagement with the fixed anvil.
Figure 11:
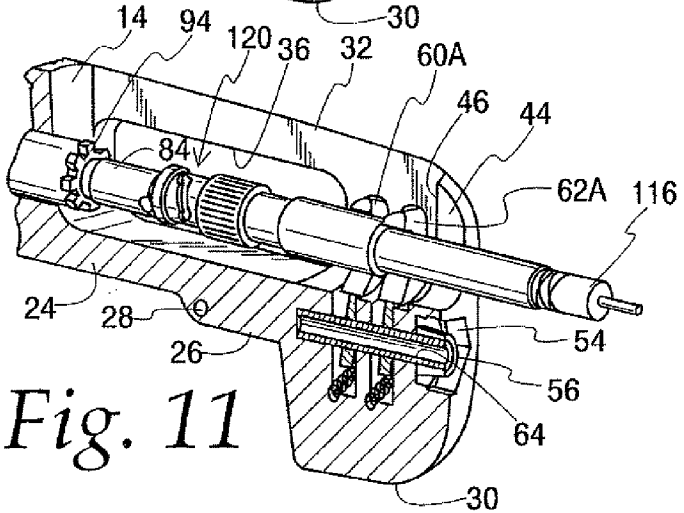
FIG. 11 is a perspective view of a longitudinal section through the compression zone, showing an BNC-type connector loaded in engagement with the second anvil.
Figure 10:
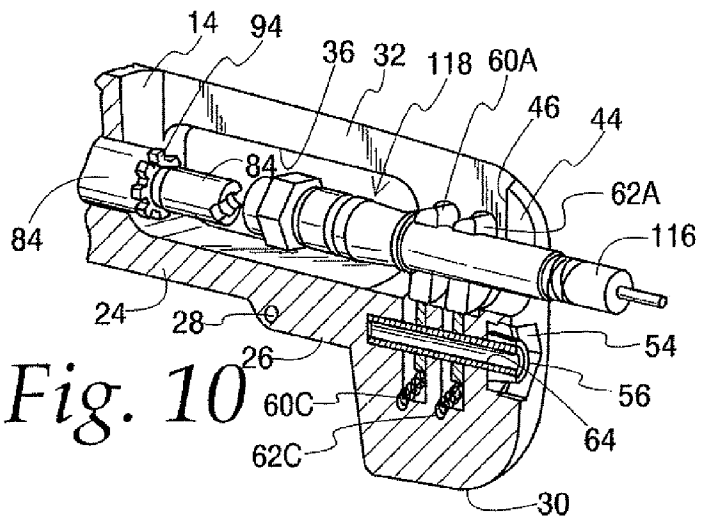
FIG. 10 is a perspective view of a longitudinal section through the compression zone, showing an F-type connector loaded in engagement with the first anvil.

Once the connector is properly seated on the cable, the connector/cable combination is placed into the compression zone 42 by a radial movement between the side walls 32, 34. The cable engages the entry surfaces of the spring clips and forces them apart sufficiently to permit the cable to fit into the cable receiving receptacle defined by the apertures 80 of the spring clips. Once the cable enters the receptacle the clip springs 60C and 62C will push the spring clips back to a closed position about the cable wherein the upper quadrant of the spring clip will engage the cable. The cable will extend out the front of the tool through the U-shaped opening 52. The rear edge of the connector engages the bearing surfaces of one of the movable anvils or the abutments, depending on the size of the connector. FIG. 10 illustrates that a typical F-type connector 118 will engage the first anvil 60. FIG. 11 shows a BNC connector 120 in engagement with the second anvil 62. FIG. 12 illustrates that an RG-11 F-connector 122 is so large that its rear edge will extend all the way to the fixed bearing surfaces 46, 50 of the abutments 44, 48.

With the rear edge of the connector in engagement with the appropriate bearing surface the user squeezes the handle 100 toward the base 12. The push rod 96 then pushes the plunger forwardly. The push head 90 engages the front end of the connector. Continued movement of the slide rod and push head combination compresses the connector between the push head and the bearing surfaces, thereby compressing the connector and locking it onto the cable. The user then releases the handle 100. The torsion spring 108 moves the handle to the open position, which causes the plunger to retract and disengage the connector. With the other hand, the user can then translate the finished cable out of the compression zone by a radial movement out the top of the compression zone. There is no need to manually engage the spring clips because their shape allows the user to simply lift the cable out of the compression zone. The spring clips will release the cable without undue effort on the part of the user. The tool is then ready for the next application. When the user is finished, the handle can be closed and the hasp rotated to retain the handle in the closed position.

Figure 18:
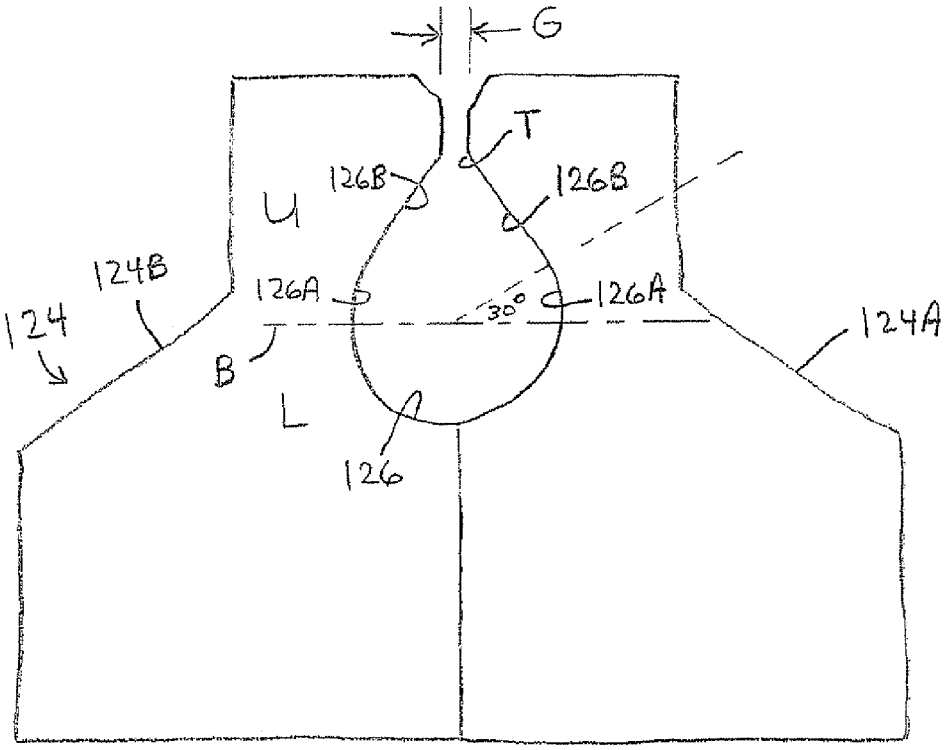
FIG. 18 is a view similar to FIG. 9, showing an alternate embodiment of the anvil.

FIG. 18 illustrates an alternate embodiment of an anvil 124. This anvil has left and right spring clips 124A, 124B. These may be generally similar to the spring clips described above except for the shape of the aperture 126. Aperture 126 has a tear-drop shape. That is, the lower quadrants of the aperture are circular but the retention surfaces in the upper quadrants have both a circular portion 126A and a tangential portion 126B. The circular portion 126A defines an arc above the horizontal centerline B of about 30°. The retention surface then merges into the tangential portion 126B, which is generally straight. The tangential portion ends at terminus T. There is a gap or throat G between the termini of the two spring clips.

Figure 19:
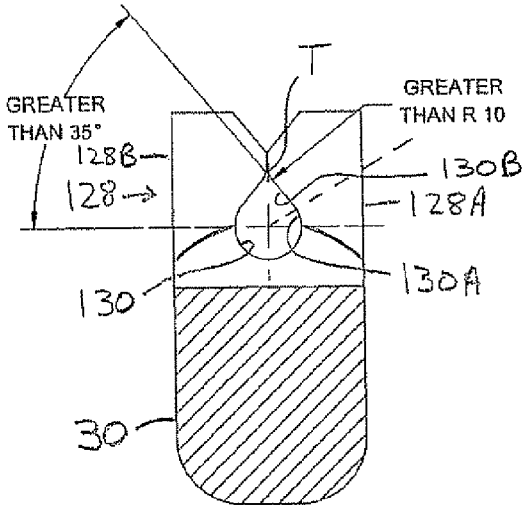
FIG. 19 is a view similar to FIG. 9, showing a further alternate embodiment of the anvil.

FIG. 19 illustrates a further alternate embodiment of an anvil 128. As is the case with all the anvils, anvil 128 has left and right spring clips 128A, 128B which are similar to those described above except for the shape of the aperture 130. Aperture 130 has a tear-drop shape similar to the aperture 126 but in this case there is no gap or throat between the clips. Thus, the lower quadrants of the aperture are circular but the retention surfaces in the upper quadrants have both a circular portion 130A and a tangential portion 130B. The circular portion 130A defines a circular arc above the horizontal centerline of about 30°. The aperture then merges into the tangential portion 130B. As shown in the figure, the tangential portion 130B defines an angle of greater than 35° with the horizontal centerline B. The tangential portion may have a small arc at its upper end just prior to terminus T. The termini are in contact with each other when the spring clips are closed. There is no gap or throat between the termini of the two spring clips.

In both of the tear-drop configurations of FIGS. 18 and 19, the retention surface defined by the arcuate portion and the tangential portion provides the desired balance between retention ability before and during compression and ease of release after compression. It will be understood that the retention surface could have shapes other than the tear-drop configuration shown. For example, instead of having an arcuate portion, the retention surface could just have a straight tangential portion starting at the horizontal centerline. In such a configuration the tangential portion would not be tangential to the support surface in a strict geometric sense, but it will be understood that the term "tangential" as used herein is broad enough to cover alternative arrangements of the retention surface that do not meet strict geometric conditions. What is important is that the retention surface in these alternate embodiments have a portion that leads or slopes into the parting line between the spring clips. As a result of the leading configuration of the retention surface, outward radial movement of the cable will produce a lateral force on the spring clips that tends to separate the spring clips and allow release of the cable. The precise combination of arcuate, straight, curved or angular surfaces that comprise the retention surface may vary so long as the combination produces a lateral, separating force on the spring clips when a cable is moved radially outwardly of the compression zone.

While the preferred form of the invention has been shown and described herein, it should be realized that there may be many modifications, substitutions and alterations thereto without departing from the scope of the following claims.

We claim:

1. A tool for installing compression-type coaxial cable connectors, comprising:

a base including a block member, a beam extending from the block member, and first and second laterally-spaced side walls extending from the beam;

the block member, beam and side walls defining a compression zone for removably receiving therein an end portion of a coaxial cable and a compression connector therefor;

a plunger retractably insertable along a longitudinal axis from the block member into the compression zone for engagement with the free end of a compression connector; and at least one anvil retractably insertable into the compression zone between open and closed positions, the anvil having an aperture for removably receiving therein a coaxial cable and a bearing surface for abutting a portion of the back end of a compression connector when the anvil is in the closed position, the anvil having left and right lower quadrants and left and right upper quadrants which together define the aperture, the upper quadrants being separated by a gap of about 0.075 inches to about 0.250 inches.

2. The tool of claim 1 wherein the anvil comprises left and right spring clips, each spring clip having a lower quadrant and an upper quadrant.

3. The tool of claim 2 wherein the spring clips are pivotably mounted in laterally-aligned slots formed in the side walls.

4. The tool of claim 1 further comprising a second anvil retractably insertable into the compression zone between open and closed positions, the second anvil having an aperture for removably receiving therein a coaxial cable and a bearing surface for abutting a portion of the back end of a compression connector when the anvil is in the closed position, the anvil having left and right lower quadrants and left and right upper quadrants which together define the aperture, the upper quadrants being separated by a gap of about 0.075 inches to about 0.250 inches.

* * * * *